US005236277A

United States Patent [19]

Hybertson

[11] Patent Number: 5,236,277

[45] Date of Patent: Aug. 17, 1993

[54] SIDEWALK GROOVING TOOL

[76] Inventor: Delmer L. Hybertson, P.O. Box 127, Centerville, S. Dak. 57014

[21] Appl. No.: 900,658

[22] Filed: Jun. 19, 1992

[51] Int. Cl.[5] ..... E01C 23/09

[52] U.S. Cl. ..... 404/89; 249/52; 425/458

[58] Field of Search ..... 404/89, 93, 94; 16/111 R, 112, 113; 403/83; 248/164; 182/185; 249/52, 214, 217; 425/458

[56] References Cited

U.S. PATENT DOCUMENTS

| | | | |
|---|---|---|---|
| 4,680,949 | 7/1987 | Stewart | 70/58 X |
| 4,822,209 | 4/1989 | Dragich | 404/89 |
| 4,921,372 | 5/1990 | Hybertson | 404/89 |
| 4,985,961 | 1/1991 | Kegley | 16/111 R |

*Primary Examiner*—William P. Neuder

[57] ABSTRACT

An improved sidewalk grooving tool usable by a standing worker but having foldable handles for flat storage and transport.

5 Claims, 1 Drawing Sheet

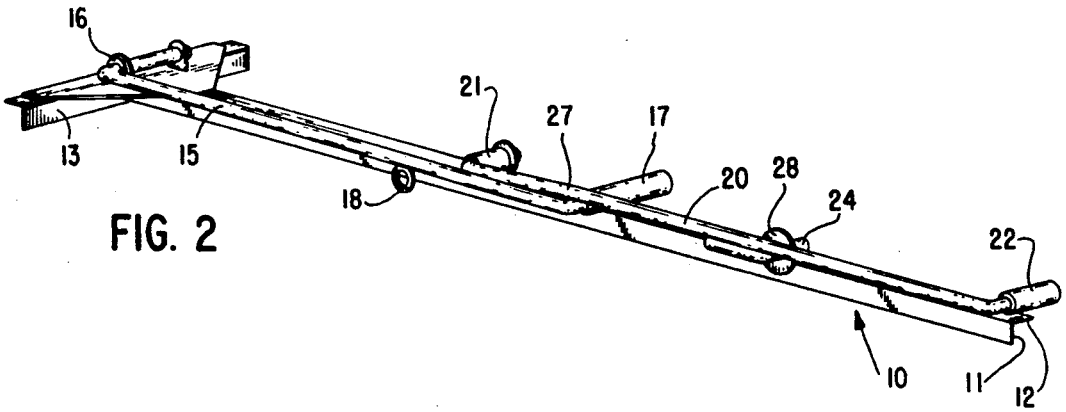
FIG. 2
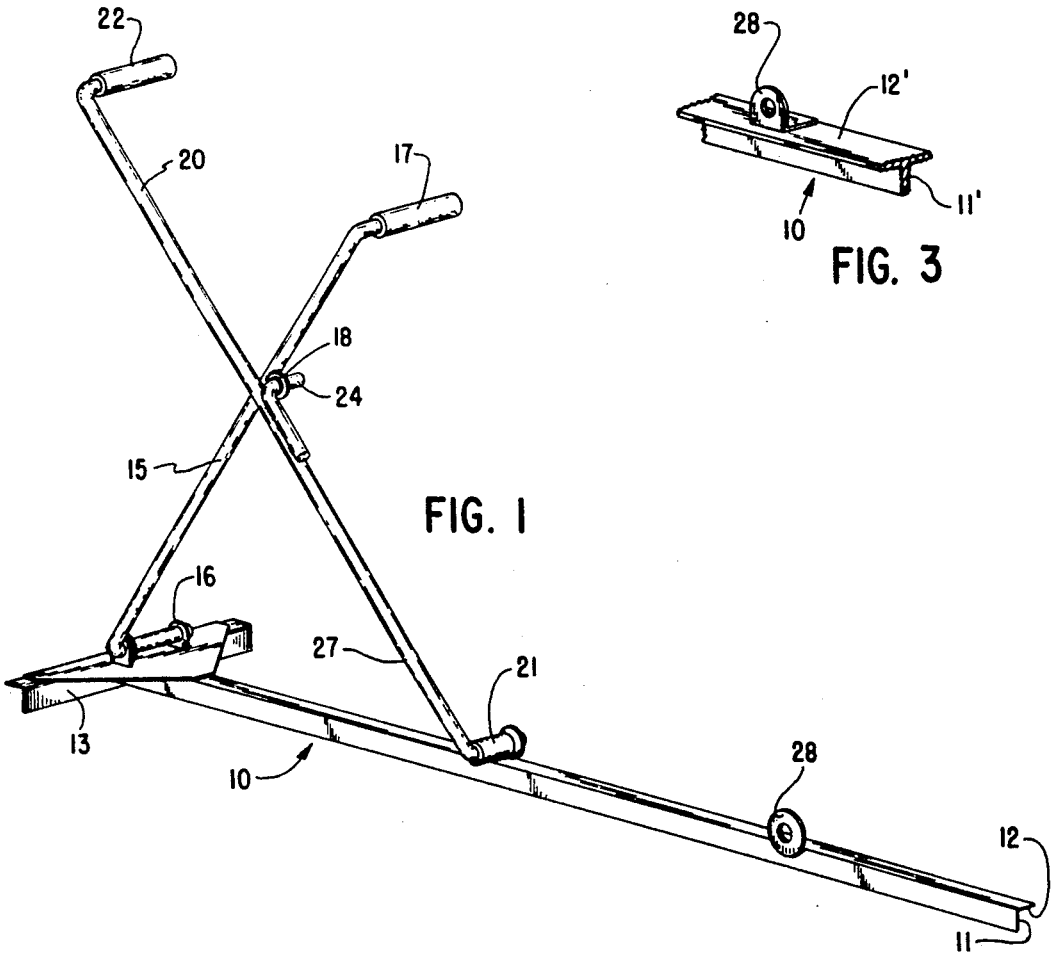
FIG. 1
FIG. 3

SIDEWALK GROOVING TOOL

BACKGROUND AND SUMMARY OF THE INVENTION

This invention pertains to sidewalk grooving tools of the type disclosed in my previous U.S. Pat. No. 4,921,372, issued May 1, 1990,and more particularly to such a tool which has handles that fold down adjacent to the blade for relatively easier storage and transport.

The tool shown in my previous patent noted above operates very satisfactorily in that it allows a worker to stand adjacent the sidewalk and groove the walk. However, because the grips and guide bar extend transversely to the principle blade; and because the handles are fixed at an angle to the blade, the device is rather clumsy to store either while not in use or while being transported.

By the present invention, I provide for a tool in which the handles fold down to the blade to provide for a compact unit which may be placed in a relatively small space so that storage is made much simpler and easier.

BRIEF DESCRIPTION OF THE DRAWINGS

FIG. 1 is a perspective view of the tool as assembled for use, and

FIG. 2 is a similar view of the tool folded for storage, and

FIG. 3 is a partial view of the end of the bar showing an alternate cross section.

DESCRIPTION

Briefly, this invention is an improvement in the sidewalk grooving tool of my previous invention patented as U.S. Pat. No. 4,921,372 on May 1, 1990 which comprises a pair of folding handles which lie along the grooving bar and are held in that position by simple holding means.

More specifically and referring to the drawings, the tool operates to scribe a sidewalk using a scribing bar 10 which may have the cross section of an angle iron as illustrated, or may be of T-shaped cross section. One flange 11 of the bar is adapted to be pressed into soft concrete to form the scribed line common in all sidewalks. The cross flange 12 provides a gage to control the depth of the groove. The T-shape as shown in FIG. 3 may be preferred by some because the cross flange 12' extends on both sides of the vertical or scribing flange 11'.

A cross member 13 at one end of the bar 10 forms a T with that bar and serves as a guide to be set against the form defining the edge of the sidewalk. In this way, the direction of the groove in the walk can be reasonably certain to be perpendicular to the edge of the walk.

To use the device, a couple of handles extending upward from the bar 10 allow a worker to stand alongside the walk and press the bar into the unhardened concrete. In the original device, the handles were welded or otherwise fixed to the bar and worked well in use. The problem encountered was in storage.

In the present device, there are two handles. A first handle 15 is pivoted to the cross member 13 by a hinge-like device 16 so that the handles can be readily pivoted through about 180 degrees of movement. A grip 17 is provided so that the operator can press the device into the concrete. On the handle spaced somewhat closer to the grip 17 than to the hinge 16, is a loop 18 for a purpose to be described later.

The second handle 20 is pivoted to the top of the bar 10 at a hinge 21 spaced substantially from the cross member 13. This handle also has a grip at the end opposite to the hinge 21 so that the position of the blade 10 can be guided and pressed into the concrete.

As shown in FIG. 1, when in use the handles 15 and 20 are crossed in a triangular shape so that both grips 17 and 22 are substantially carried above the bar 10. The handles are retained in that position by the engagement between a pin 24 and the ring 18. The pin 24 is fixed to the second handle 20 by welding or the like and extends laterally from that handle so that it can extend through the ring. It should be noted that there is sufficient spring flexibility in the handles that the pin 24 may be readily disengaged from the ring 18. However, for use, the bias of the spring action in the handles is to press the handles together so that the pin 24 and ring 18 stay engaged.

In order to fold the tool, the handles are sprung to disengage the pin 24. The handle 20 is the then moved around the grip 17 on the handle 15 to a position behind the handle 15 as shown in dashed lines in FIG 1. From this position, the blade 10 can be pulled upward by pulling the handle 20 until the handles 15 and 20 lie substantially alongside the blade 10. Although FIG. 2 shows the tool lying flat for storage, the relative position of the handles and the bar are as they would be if pulled to a vertical position as described. It should be noted that the grip 17 on the handle 15 is now between the blade 10 and the handle 20 and is thus held in place. To facilitate achieving this position, the handle 20 should be slightly bent at 27 to accommodate the grip 17.

In order to keep the tool in the folded position, a ring 28 is fixed to the blade in position to be engaged by the pin 24, and again the springiness of the handle 20 and the direction of bias of springiness makes the engagement and holding of the engagement possible.

From the above description, the usefulness of the improvement will be obvious. In use, the grips 17 and 22 are in position for a worker, while standing, to press the blade into the soft concrete. To fold the tool, the workers sets his foot against the cross member 13, disengages the pin 24 from the ring 18 and while pulling the blade 10 upward, moves the handle 20 around the grip 17. Further pulling the blade 10 to an upright position results in the juxtaposition of the two handles 15 and 20 with the blade 10 as shown in FIG 2. At this point, the pin 24 can be engaged with the ring 28 to hold the tool folded together to then be laid down in a pickup or other truck to be transported to the next job site.

I claim as my invention:

1. A sidewalk grooving tool comprising a blade having a flange adapted to press a groove into soft concrete poured to form a sidewalk, a first elongated handle hinged to said blade near an end thereof, a second elongated handle hinged to said blade at a point substantially spaced from the hinge location of said first handle, means engageable between said handles to hold said handles in position to form a triangle with said blade whereby the ends of said handle opposite the hinged ends are displaced laterally from said blade, said engageable means being disengageable whereby said handles are free to be moved to close juxtaposition with said blade.

2. The tool of claim 1 in which said handles are formed of springable material, said means engageable between said handles being releasably held in engagement by a springy bias of said handles toward each other.

3. The tool of claim 2 in which said means engageable between said handles include a pin fixed to one handle and a ring fixed to the other handle, said pin being insertable into said ring.

4. The tool of claim 2 in which both handles include laterally extending grips, said second handle, when said means engageable between said handles is disengaged being movable around said grip on said first handle, both handles then being pivotable about their respective hinged ends to a position lying alongside said blade.

5. The tool of claim 1 in which said means engageable between said second handle and said blade hold said handle relatively in said position alongside said blade.

* * * * *